US005890974A

United States Patent [19]

Stiefel et al.

[11] Patent Number: 5,890,974

[45] **Date of Patent: *Apr. 6, 1999**

[54] TETRAHEDRAL DIMPLE PATTERN GOLF BALL

[75] Inventors: Joseph F. Stiefel, Ludlow; Dennis Nesbitt, Westfield, both of Mass.

[73] Assignee: Lisco, Inc., Tampa, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 665,147

[22] Filed: Jun. 13, 1996

[51] Int. Cl.[6] ..... A63B 37/14

[52] U.S. Cl. ..... 473/384

[58] Field of Search ..... 473/383, 384

[56] References Cited

U.S. PATENT DOCUMENTS

| | | | |
|---|---|---|---|
| 4,560,168 | 12/1985 | Aoyama . | |
| 4,772,026 | 9/1988 | Gobush . | |
| 4,869,512 | 9/1989 | Nomura et al. | 473/383 |
| 4,946,167 | 8/1990 | Yamada | 473/384 |
| 5,009,427 | 4/1991 | Stiefel et al. | 40/327 X |
| 5,060,953 | 10/1991 | Bunger et al. . | |
| 5,415,410 | 5/1995 | Aoyama . | |

*Primary Examiner*—George J. Marlo
*Attorney, Agent, or Firm*—Laubscher & Laubscher

[57] ABSTRACT

A golf ball including two poles and an equator is characterized by the arrangement of a preselected number of dimples in a geometrical lattice configuration based upon a subdivided tetrahedron on the surface thereof The lattice includes six dimple-free great circles around the circumference of the ball, one of the circles corresponding with the equator and another of the circles passing through the poles. All of the circles define twenty-four generally equivalent triangles, twelve in each hemisphere of the ball. An equal number of dimples are arranged within each of the triangles, and the dimple arrangement in at least two of the triangles is different from the dimple arrangement in the remaining triangles.

7 Claims, 2 Drawing Sheets

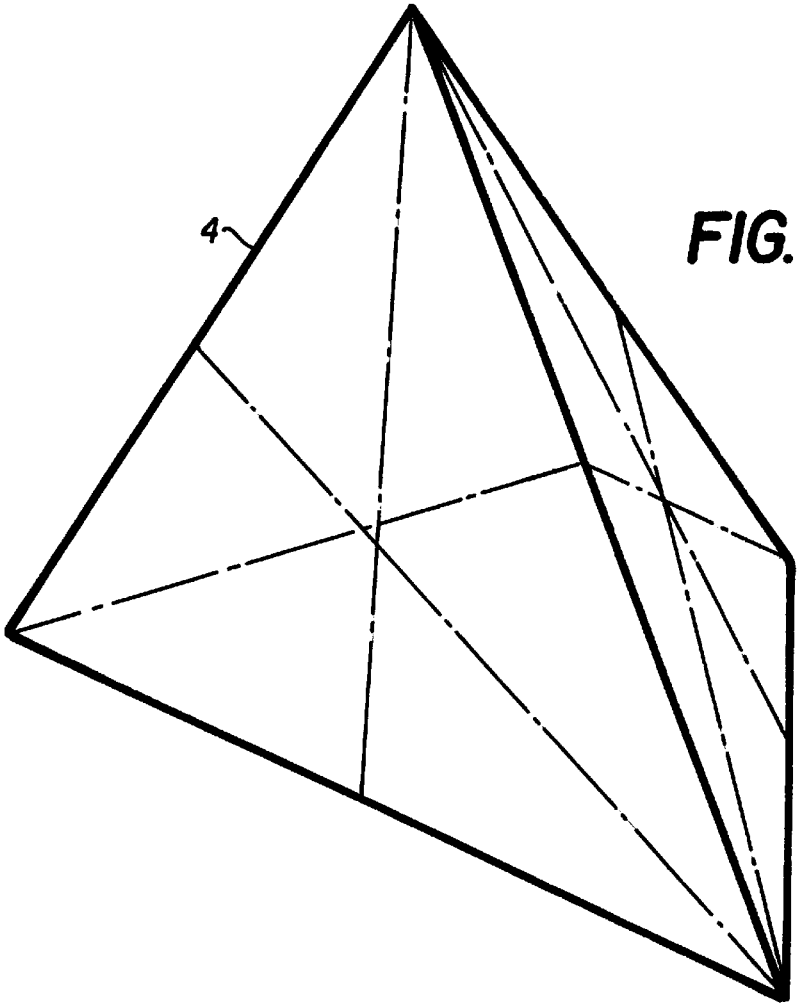
FIG. 3
FIG. 4
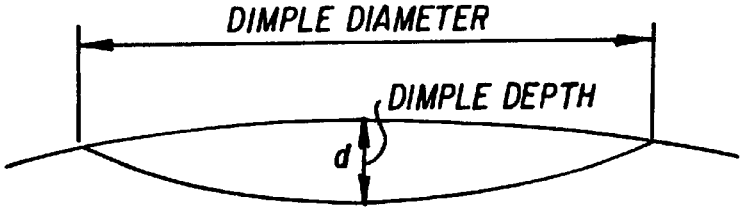

TETRAHEDRAL DIMPLE PATTERN GOLF BALL

BACKGROUND OF THE INVENTION

The present invention relates to golf balls and more particularly to a specific arrangement of dimples on a golf ball.

It is well-known that for any given selected number of dimples on a golf ball, it is desirable that the area of the surface of the golf ball covered by the dimples be a maximum in order to provide the best flight characteristics for the ball. Moreover, U.S.G.A. rules of golf require that the ball be designed and manufactured to perform in general as if it were aerodynamically symmetrical. A dimpled golf ball may be geometrically symmetrical and not aerodynamically symmetrical. An example of a golf ball which is both geometrically symmetrical and aerodynamically symmetrical is a smooth sphere. As is well known, this ball is not capable of providing the necessary performance required in present day golf.

While a great deal of the surface of the ball may be covered with dimples if the dimples are quite small, it has been found that this imparts some undesirable characteristics to the ball. At the same time, when larger diameter dimples are used and all of the dimples are the same size, there is a considerable surface of the ball remaining after the dimples are arranged on the surface.

BRIEF DESCRIPTION OF THE PRIOR ART

Golf balls containing various dimple patterns and sizes are well-known in the patented prior art. The Gobush U.S. Pat. No. 4,772,026, for example, discloses a golf ball having six great circular paths obtained by inscribing a cubical pattern on the surface of the ball and dividing each face of the cube into four isoscles triangles by bisecting each face twice. The resulting twenty-four triangles are filled with dimples. The Stiefel et al U.S. Pat. No. 5,009,427 discloses a golf ball having dimples arranged in a modified icosohedral lattice, where the dimples have one of two different diameters. Similarly, the Aoyama patent No. 4,560,168 discloses a golf ball dimple pattern based on a regular icosahedron. The pattern results in six dimple-free equatorial lines. Each spherical triangle of the icosahedron is subdivided into four smaller triangles, thereby defining eighty subtriangles. The Bunger et al U.S. Pat. No. 5,060,953 discloses a golf ball having dimples of one of three different diameters. The dimples are arranged on clockwise and counterclockwise arcs between the pole and equator of each hemisphere, and on the surface area between the arcs. Finally, the Aoyama U.S. Pat. No. 5,415,410 discloses a golf ball including a three parting line quadrilateral dimple pattern.

The present invention was developed to provide a new golf ball dimple pattern based on a tetrahedral design which provides improved flight characteristics to the ball.

SUMMARY OF THE INVENTION

Accordingly, it is a primary object of the invention to provide a golf ball having two poles and an equator and a preselected number of dimples covering the surface of the ball and arranged in a geometrical lattice configuration based upon a subdivided tetrahedral lattice. The lattice includes six dimple-free great circles around the circumference of the ball, one of the circles corresponding with the equator and another of the circles passing through the poles.

The lattice circles define twenty-four generally equivalent triangles on the surface of the ball, twelve in each hemisphere. Nineteen dimples are arranged within each of the triangles.

According to another object of the invention, the dimples have one of three diameters, at least two dimples of each diameter being arranged in each triangle.

BRIEF DESCRIPTION OF THE FIGURES

Other objects and advantages of the invention will become apparent from a study of the following specification, when viewed in the light of the accompanying drawing, in which:

FIG. 3 is a perspective view of a subdivided regular tetrahedron; and

FIG. 4 is a schematic illustration of the dimple diameter and depth.

DETAILED DESCRIPTION

Figure 1:
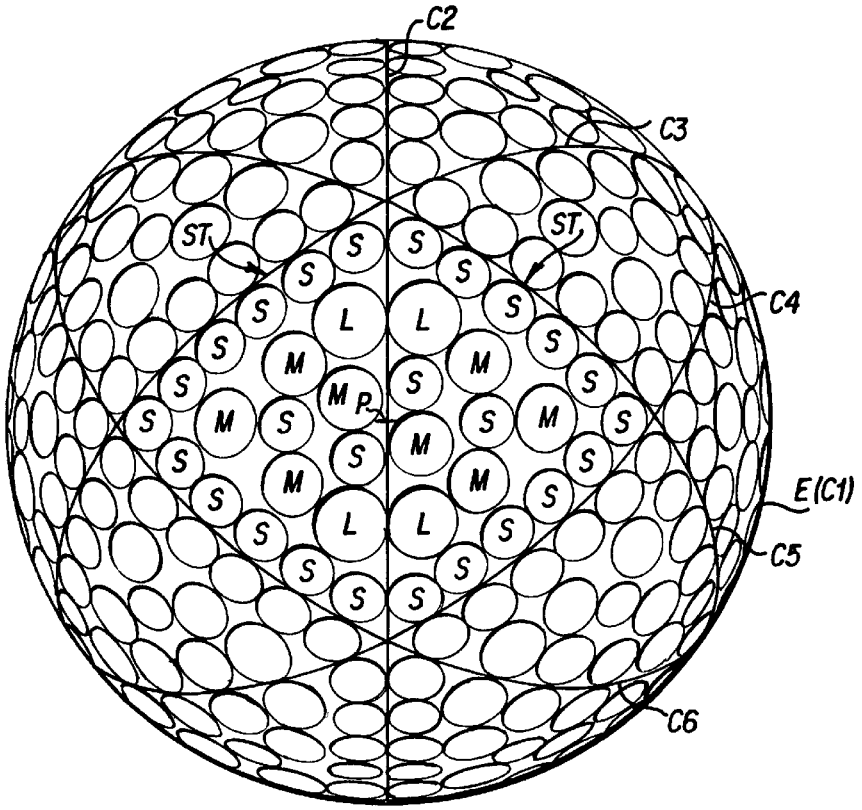
FIG. 1 is a top plan view taken from one of the poles of a golf ball according to the invention.
Figure 2:
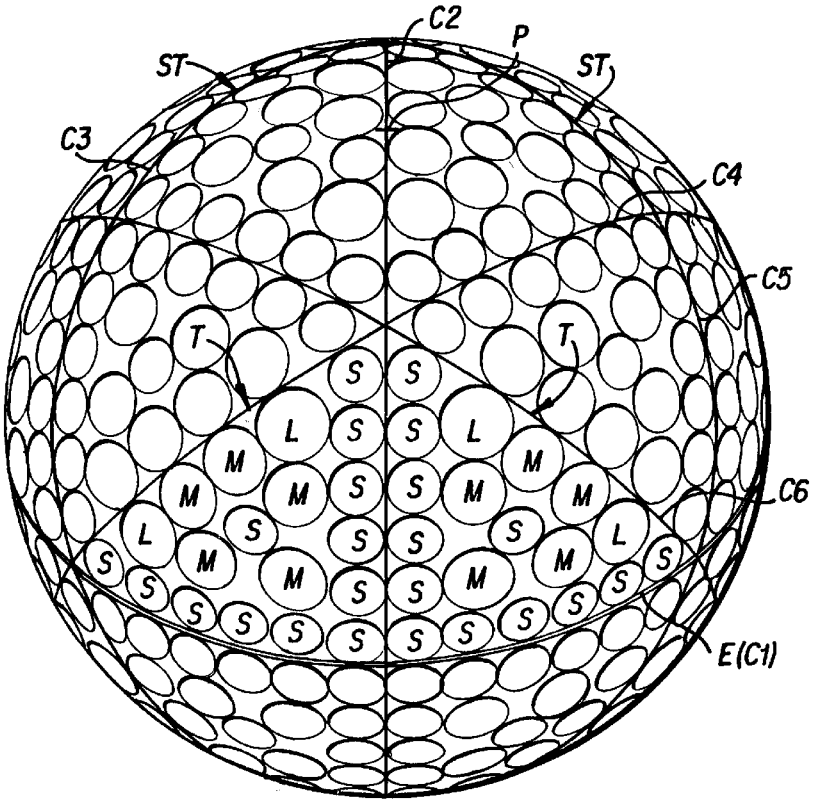
FIG. 2 is a plan view taken along an offset line from the equatorial line of the golf ball of FIG. 1.

Referring to FIGS. 1 and 2, there is shown a golf ball 2 having a unique dimple pattern according to the invention. The ball has two poles P and an equatorial line E. As with nearly all golf balls, the equatorial line E is free of dimples. Since golf balls are molded and manufactured by using two hemispherical half molds having straight edges, the ball on exiting the mold has a flash line about the equatorial line created by the two hemispheres of the mold. Because this line is dimple free, the flash can easily be cleaned from the ball.

There is shown in FIG. 3 a true tetrahedron 4. The dashed lines in the figure are drawn on each surface of the tetrahedron from a vertex to a midpoint at the edge opposite the vertex. Thus, each of the four surfaces of the tetrahedron are subdivided into six triangles. This geometrical configuration can be applied to the spherical surface of a golf ball using six great circles C1–C6 arranged as shown in FIGS. 1 and 2.

One of the great circles C1 is coincident with the equator E of the golf ball. Another great circle C2 passes through the poles of the ball. The remaining great circles C3–C6 are arranged on the ball surface in order to define twenty-four generally equivalent triangles, twelve in each hemisphere. All of the great circles C1–C6 are dimple-free.

When applying the true tetrahedral configuration to a golf ball surface, it turns out that the two triangles ST which straddle each pole P differ slightly from the remaining triangles T, all of which are identical. This difference is accommodated with different dimples as will be developed below.

Since the six great circles C1–C6 are dimple-free, all of the dimples are arranged within the triangles between the lines. Preferably, each triangle contains nineteen dimples, whereby the ball surface contains 456 dimples. The dimples are provided in one of three diameters D1, D2, D3. The larger dimples L have a first diameter D1. The medium dimples M have a second diameter D2 which is less than D1. The smaller dimples S have a third diameter D3 which is less than D2. Preferably, each triangle has at least two dimples of each diameter.

According to a preferred construction, the straddling triangles ST each include two larger dimples L, four medium dimples M, and thirteen smaller dimples S. The remaining triangles T each include two larger dimples L, five medium dimples M, and twelve smaller dimples S.

In FIG. 4 is shown the manner for measuring the depth and diameter of each dimple. The depth d is measured from the bottom center of the dimple along a radius to the projected outer periphery of the ball above the dimple. The diameter D is defined as the chordal distance between the intersection of the ball's periphery and lines drawn tangent to the side dimple walls at 0.003 inch below the periphery of the ball.

Although the dimensions may vary slightly, the large L, medium M, and small S dimples preferably have the following diameters D and depth d

| | L | M | S |
|---|---|---|---|
| D | 0.160in. | 0.150in. | 0.125in. |
| d | 0.0109in. | 0.0102in. | 0.0085in. |

The flight characteristics of the ball bearing the inventive dimple pattern meet all of the required U.S.G.A. standards as to symmetry and the ball has excellent performance characteristics.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. A golf ball having two poles and an equator and having a preselected number of dimples covering the surface of the ball and arranged in a geometrical lattice configuration based upon a subdivided tetrahedral lattice, said lattice and dimples comprising (a) six dimple-free great circles around the circumference of the ball, one of said circles corresponding with the equator and one of said circles passing through the poles, all of said circles defining twenty-four generally equivalently sized and shaped triangles on the surface of the ball, twelve in each hemisphere; and (b) an equal number of dimples arranged within each of said triangles, the dimple arrangement in at least two of said triangles being different from the dimple arrangement in the remaining triangles.

2. A golf ball as defined in claim 1, wherein each triangle contains nineteen dimples.

3. A golf ball as defined in claim 2, wherein said dimples comprise a first plurality of dimples having a first diameter, a second plurality of dimples having a second diameter less than said first diameter, and a third plurality of dimples having a third diameter less than said second diameter.

4. A golf ball as defined in claim 3, wherein at least two dimples of each of said first, second, and third plurality of dimples are arranged in each triangle.

5. A golf ball as defined in claim 4, wherein two of said triangles straddle each of the poles to define four straddling triangles, said straddling triangles containing two dimples having said first diameter, four dimples having said second diameter, and thirteen dimples having said third diameter, the remaining of said triangles containing two dimples having first diameter, five dimples having said second diameter, and twelve dimples having said third diameter.

6. A golf ball as defined in claim 4, wherein said first diameter is substantially 0.160 inch, said second diameter is substantially 0.150 inch, and said third diameter is substantially 0.125 inch.

7. A golf ball as defined in claim 6, wherein the depth of the dimples having said first diameter is substantially 0.0109 inch, the depth of the dimples having said second diameter is substantially 0.0102 inch, and the depth of the dimples having said third diameter is substantially 0.0085 inch.

* * * * *